US007530153B2

(12) United States Patent
Doan et al.

(10) Patent No.: US 7,530,153 B2
(45) Date of Patent: May 12, 2009

(54) ATTACHING COMPONENTS OF A CARRIER HEAD

(75) Inventors: Trung T. Doan, Los Gatos, CA (US); Jeffrey Schmidt, San Jose, CA (US); Douglas R. McAllister, Pleasanton, CA (US); Stacy Meyer, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 328 days.

(21) Appl. No.: 11/233,154

(22) Filed: Sep. 21, 2005
(Under 37 CFR 1.47)

(65) Prior Publication Data

US 2007/0143980 A1 Jun. 28, 2007

(51) Int. Cl.

| | |
|---|---|
| ***B23P 11/00*** | (2006.01) |
| ***B23P 19/00*** | (2006.01) |
| ***B23P 21/00*** | (2006.01) |
| ***B23Q 17/00*** | (2006.01) |
| ***B23Q 17/24*** | (2006.01) |

(52) U.S. Cl. ..... 29/407.01; 29/407.02; 29/407.04; 29/407.05; 29/407.09; 29/407.1; 29/525.01; 29/709

(58) Field of Classification Search ..... 29/407.01, 29/407.02, 407.04, 407.05, 407.09, 407.1, 29/525.01, 525.11, 709, 712, 714; 81/469, 81/57.36; 173/1, 4, 5, 6, 7, 176, 181, 214, 173/217; 356/318

See application file for complete search history.

(56) References Cited

U.S. PATENT DOCUMENTS

| | | | | |
|---|---|---|---|---|
| 2,964,152 | A * | 12/1960 | Banner | 192/56.32 |
| 3,965,778 | A * | 6/1976 | Aspers et al. | 81/470 |
| 4,104,779 | A * | 8/1978 | Sigmund | 29/407.02 |
| 5,123,158 | A * | 6/1992 | Dixon | 29/714 |
| 5,218,758 | A * | 6/1993 | Nguyen | 29/837 |
| 5,549,169 | A * | 8/1996 | Matsumura et al. | 173/176 |
| 6,047,455 | A * | 4/2000 | Hansson | 29/407.02 |
| 6,068,548 | A | 5/2000 | Vote et al. | |
| 6,189,418 | B1 * | 2/2001 | Sloan et al. | 81/57.36 |
| 6,206,768 | B1 | 3/2001 | Quek | |
| 6,263,605 | B1 | 7/2001 | Vanell | |
| 6,321,437 | B1 * | 11/2001 | Sloan et al. | 29/525.01 |
| 6,375,550 | B1 | 4/2002 | Berman | |
| 6,602,114 | B1 | 8/2003 | Wang et al. | |
| 7,062,831 | B2 * | 6/2006 | Walt et al. | 29/407.02 |
| 2005/0191947 | A1 | 9/2005 | Chen et al. | |

FOREIGN PATENT DOCUMENTS

| | | | |
|---|---|---|---|
| KR | 2003-0058501 | A | 7/2003 |
| KR | 2004-0037764 | A | 5/2004 |
| KR | 2004-0095051 | A | 11/2004 |

(Continued)

OTHER PUBLICATIONS

The Cornell NanoScale Science & Technology Facility (CNF), Chemical Mechanical Polishing Operating Instructions [online], [retrieved on Oct. 11, 2005].

Accretech, Tokyo Seimitsu Co., Ltd © 2005, Semiconductor Manufacturing Equipment [online], [retrieved on Oct. 11, 2005].

*Primary Examiner*—Jermie E Cozart
(74) *Attorney, Agent, or Firm*—Fish & Richardson P.C.

(57) ABSTRACT

Techniques for attaching a retaining ring to a carrier head so that the bottom surface of the retaining ring is orthogonal to a central rotational axis of the carrier head are described.

19 Claims, 6 Drawing Sheets

FOREIGN PATENT DOCUMENTS

| | | |
|---|---|---|
| TW | 434111 | 5/2001 |
| TW | 496814 | 8/2002 |
| TW | 580417 | 3/2004 |
| WO | WO 02/24410 A1 | 3/2002 |

* cited by examiner

ATTACHING COMPONENTS OF A CARRIER HEAD

BACKGROUND

This invention relates to assembling a carrier head for chemical mechanical polishing. Integrated circuits are typically formed on substrates, particularly silicon wafers, by the sequential deposition of conductive, semiconductive or insulative layers. After each layer is deposited, it is etched to create circuitry features. As a series of layers are sequentially deposited and etched, the exposed surface of the substrate becomes increasingly nonplanar. This nonplanar surface presents problems in the photolithographic steps of the integrated circuit fabrication process. Therefore, there is a need to periodically planarize the substrate surface.

One accepted method of planarization is chemical mechanical polishing (CMP). This planarization method typically requires that the substrate be mounted on a carrier or polishing head. The exposed surface of the substrate is placed against a moving polishing surface, such as a rotating polishing pad. The polishing pad may be a "standard" polishing pad with a durable roughened surface or a "fixed-abrasive" polishing pad with abrasive particles held in a containment media. The carrier head provides a controllable load to the substrate to push it against the polishing pad. A polishing slurry, which may include abrasive particles, is supplied to the surface of the polishing pad.

Some carrier heads include a flexible membrane with a mounting surface that receives the substrate. A chamber behind the flexible membrane can be pressurized to cause the membrane to expand outwardly and apply a load to the substrate. Many carrier heads also include a retaining ring that surrounds the substrate, e.g., to hold the substrate in the carrier head beneath the flexible membrane. The retaining ring, as well as other components of the carrier head, can be attached to and removed from the carrier head and one another, such as with fasteners. This can allow for cleaning the carrier head or replacing parts that become damaged or worn with use.

SUMMARY

Techniques and apparatus are described for attaching a component, such as a retaining ring, to a carrier head. The carrier head and retaining ring can be attached with fasteners. The fasteners can be fastened with a system operable to apply a controllable torque, e.g., equal torque or a desired torque, to each fastener. During the fastening process, the flatness of the bottom surface of the retaining ring as compared to the plane normal to the central rotational axis of the carrier head can be determined by taking measurements at various locations around the retaining ring. The measurements can be fed back into a controller. In response to the received measurements, the controller can adjust the torque applied to each fastener, e.g., to ensure that the retaining ring remains flat during the attachment process.

In one aspect, the invention is directed to a system for mechanically attaching parts of a carrier head together. The system has two or more fastener drivers each configured to drive a fastener into components of carrier head and a control system to regulate an electrical input into each of the fastener drivers.

Aspects of the invention may include that following. The fastener drivers can be positioned within a circumferential area of one of the components. The fastener drivers can be equidistantly spaced along a circular path within the circumferential area. The control system may control the voltage or the current supplied to each of the fastener drivers. The control system may cause the fastener drivers to each drive a drive bit at substantially equal rates. The two or more fastener drivers can each apply a torque to drive the fasteners and the control system can be configured to control the torque applied by each fastener driver such that the torque applied by each fastener driver is substantially equal. One of the components that is being fastened can be a retaining ring. The system can include a measuring system to measure whether the retaining ring is being attached to the carrier head so that a bottom surface of the retaining ring is orthogonal to a rotational center axis of the carrier head. The measuring system may be capable of measuring a distance from the retaining ring to the measuring system. The measuring system can include two or more optical measuring devices. Each of the two or more optical measuring devices may be substantially aligned with one of the fastener drivers. The measuring system can be in communication with the control system such that the measuring system sends input to the control system regarding the distance of the retaining ring to the measuring system. The control system can be configured to determine whether the retaining ring is being attached to the carrier head so that a bottom surface of the retaining ring is orthogonal to the center axis of the carrier head, if the retaining ring is not being attached to the carrier head so that the bottom surface of the retaining ring is orthogonal to the center axis, the control system adjusts the electrical input into at least one of the fastener drivers to cause the retaining ring to be attached to the carrier head so that the bottom surface of the retaining ring is orthogonal to the center axis. The measuring system may include a laser optical measuring device. The measuring system may include at least three measuring devices. The fastener drivers can each include a motor and the system can have a calibration system for determining a motor-to-motor variability in applied torque when a given value of current is delivered to each fastener driver. The calibration system can determine an adjustment value for the electrical input to each fastener driver, wherein an adjusted electrical input causes each of the fastener drivers to apply substantially equal torque.

In another aspect, the invention is directed to a method of attaching a retaining ring to a carrier head. A first component of a carrier head is aligned with a second component of the carrier head. The first component of the carrier head has two or more holes, where each of the holes is configured to receive a fastener. The second component is configured to retain the fasteners. The aligning step includes aligning the first and second components with a system having two or more fastener drivers configured to drive the fasteners into the components. The fasteners are driven into the components simultaneously.

Aspects of the invention may include that following. The method may include a step of measuring the orientation of the first component as the fasteners are being driven into the first component. The method may include determining whether the orientation of the first component is a desired orientation. If the orientation of the first component is not the desired orientation, the electrical input to at least one of the fastener drivers can be adjusted. An electrical input into the fastener drivers can be controlled so that the fastener drivers drive the fasteners at a substantially equal rate.

Potential advantages of the invention may include one or more (or none) of the following. Using the fastening device to attach multiple components of a carrier head together may ensure that the assembled carrier head has a bottom surface that is oriented orthogonal to a central axis of the carrier head.

Fastening all of the fasteners simultaneously can improve reproducibility in attaching the carrier head components. Fastening all of the fasteners simultaneously can reduce surface distortion that could be caused on a component, such as a retaining ring, when the fasteners are fastened one at a time. Sensors can provide feedback to the fastening system, so as to adjust the rate of fastening and compensate for inaccuracies in the component dimensions. Properly aligning the bottom of a retaining ring with the vertical center line of the carrier head can reduce or eliminate added time required for planarizing the retaining ring after assembling the carrier head and retaining ring. If the retaining ring is properly aligned with the carrier head, wear and tear on the retaining ring and other components of the carrier head assembly can be reduced and/or the components can wear at an even rate. If the components are property aligned, the substrate may be polished more uniformly at the edge of the substrate, potentially creating an improved polishing profile.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

A system for fastening a retaining ring to a carrier head is described.

A retaining ring 120 is a generally an annular ring that can be secured to a carrier head of a CMP apparatus. A suitable CMP apparatus is described in U.S. Pat. No. 5,738,574 and a suitable carrier head is described in U.S. Pat. No. 6,251,215, and in U.S. Publication No. 20050136800, filed Mar. 26, 2004, commonly assigned to Applied Materials, the entire disclosures of which are incorporated herein by reference. The retaining ring 120 fits into a loadcup for positioning, centering, and holding the substrate at a transfer station of the CMP apparatus. A suitable loadcup is described in U.S. Pat. No. 6,716,086, assigned to Applied Materials, the entire disclosure of which is incorporated by reference.

Figure 1:
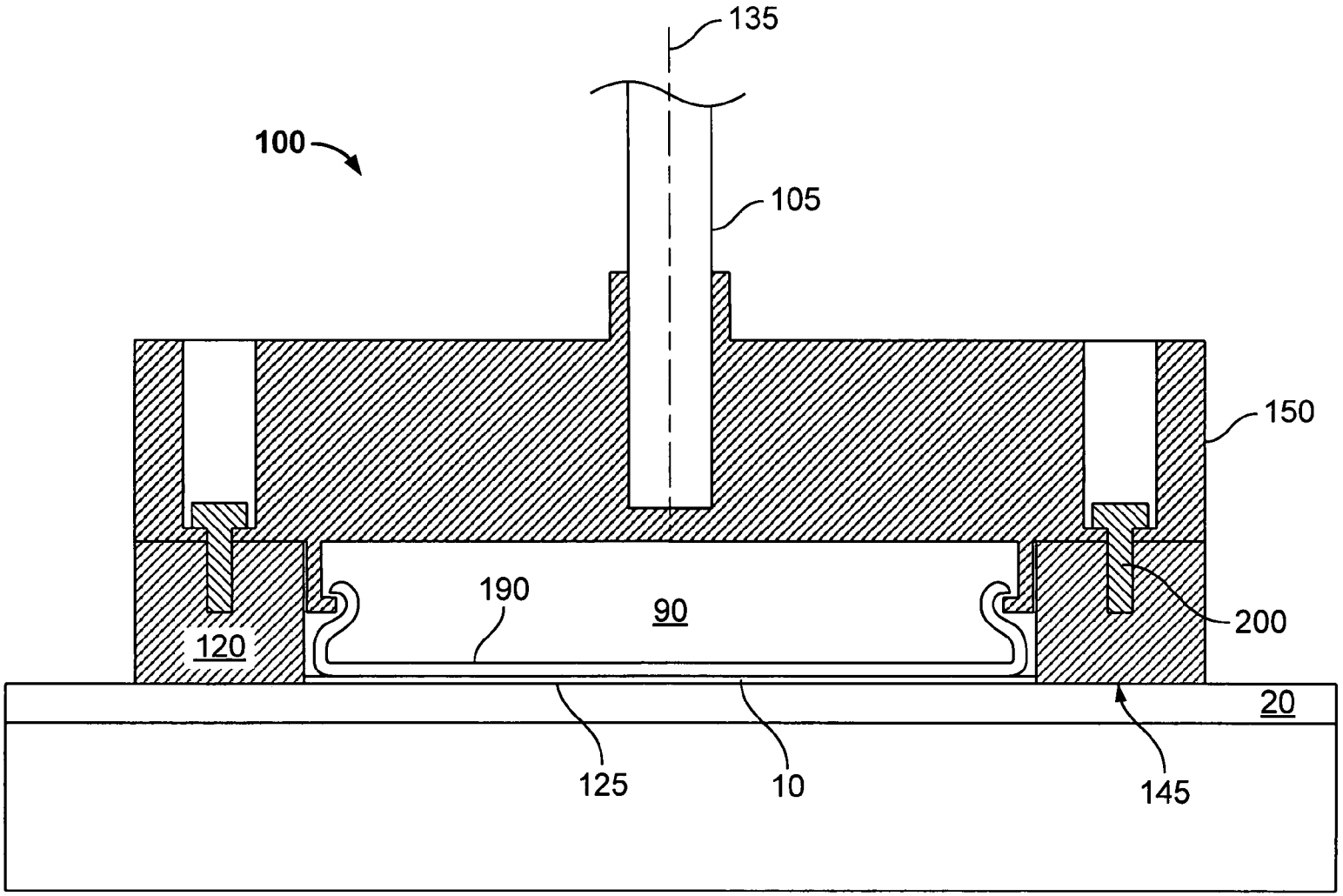
FIG. 1 is a schematic of a carrier head.

Referring to FIG. 1, a carrier head 100 is secured to a drive shaft 105 that controls the rotational motion of the carrier head 100. The carrier head 100 includes a base 150 and a retaining ring 120. A substrate backing assembly 125 attached to the base 150, or attached to a component extending from the base 150, holds a substrate 10 against a polishing surface 20. The backing assembly 125 can include a flexible membrane 190 that extends beneath the base 150 to form a chamber 90. The carrier head can include other components not illustrated for simplicity. For example, the carrier head can include a housing securable to the drive shaft, and a chamber between the housing and base can control vertical movement of the base relative to the housing.

When the carrier head 100 operates to polish the substrate 10, the backing assembly 125 holds the substrate 10 against the polishing surface 20 and distributes a downward pressure across the back surface of the substrate 10. The retaining ring 120 is attached to the bottom side of the base 150 and ensures that the substrate 10 does not slip from beneath the carrier head 100 during polishing. At least the bottom portion of the retaining ring 120 can be formed of a material that is sufficiently pliable to not damage the substrate 10 when contacting the substrate 10 during polishing, such as, polyphenylene sulfide (PPS), polyethylene terephthalate (PET), polyetheretherketone (PEEK), carbon filled PEEK, polyetherketoneketone (PEKK), polybutylene terephthalate (PBT), polytetrafluoroethylene (PTFE), polybenzimidazole (PBI), polyetherimide (PEI), polyamide-imide (PAI), or a composite material. Typically, when in use the bottom surface of the substrate backing assembly 125 and the bottom surface 145 of the retaining ring 120 are oriented substantially parallel to the polishing surface of the polishing pad 20 orthogonally to a central axis 135 of the carrier head 100.

One or more components in the carrier head 100, such as the retaining ring 120, are attached to other components in the carrier head 100, such as the base 150. The components can be held together with mechanical fasteners 200, such as bolts, screws or other appropriate mechanical fastening devices. Conventionally, the retaining ring 120 is attached to the carrier head by manually tightening the fastening devices one by one in a rotating star sequence to ensure that the torque is applied evenly across the surface of the retaining ring 120. An adjustable mechanical cam or a twist or break-away device can limit the applied torque. Attaching the retaining ring 120 to the carrier head using this method typically ensures that the central axis of the base 150 is aligned with the central axis of the retaining ring 120.

Figure 2:
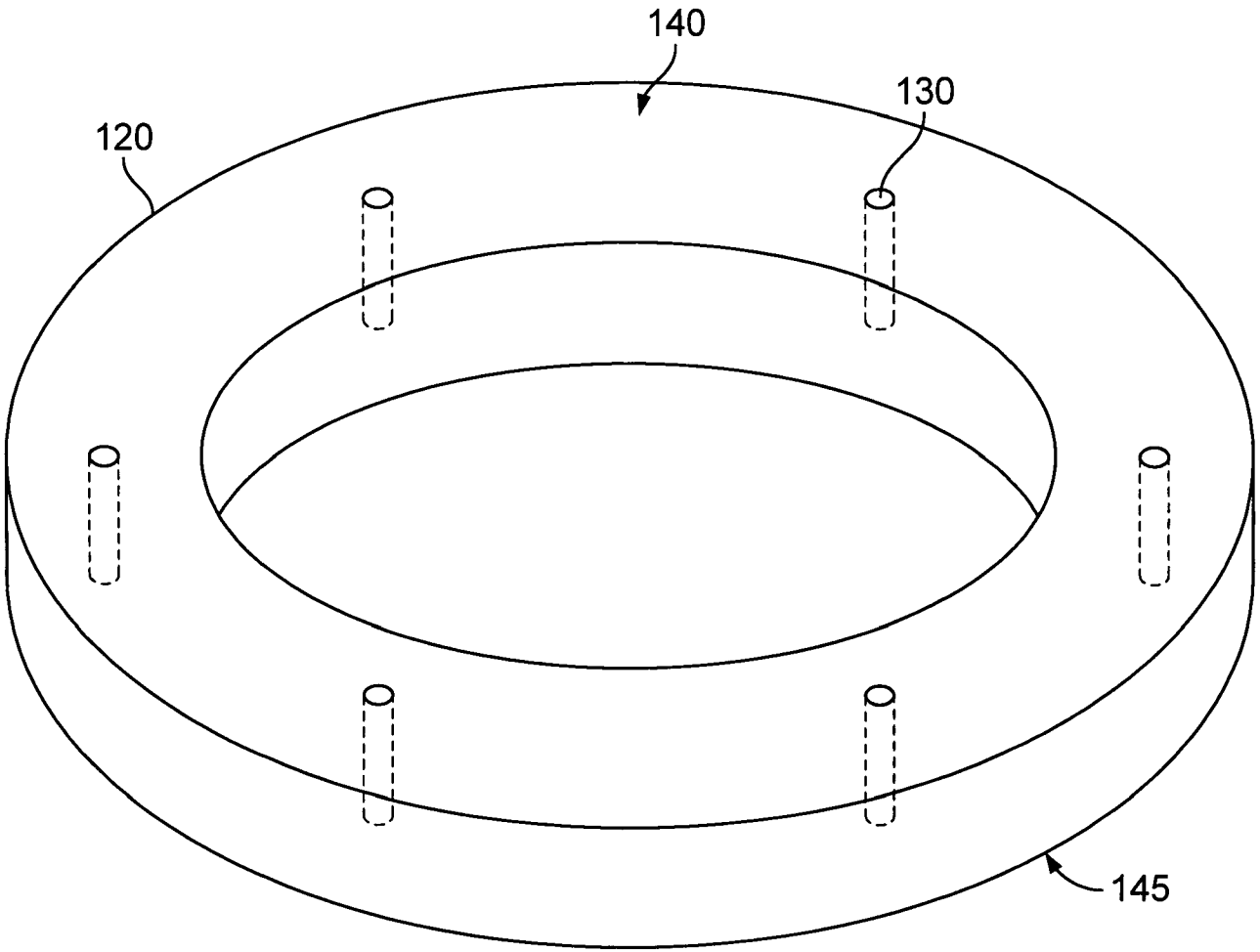
FIG. 2 is a plan view of a retaining ring.

As shown in FIG. 2, the retaining ring 120 has an upper surface 140 in which holes 130 for accepting fasteners are formed to attach the retaining ring 120 to the base 150 of the carrier head. The holes 130 can be equidistantly spaced around the perimeter of the retaining ring 120. The retaining ring 120 can include more than two holes 130, such as ten to eighteen holes. The holes 130 can be threaded or include screw sheaths.

Figure 3:
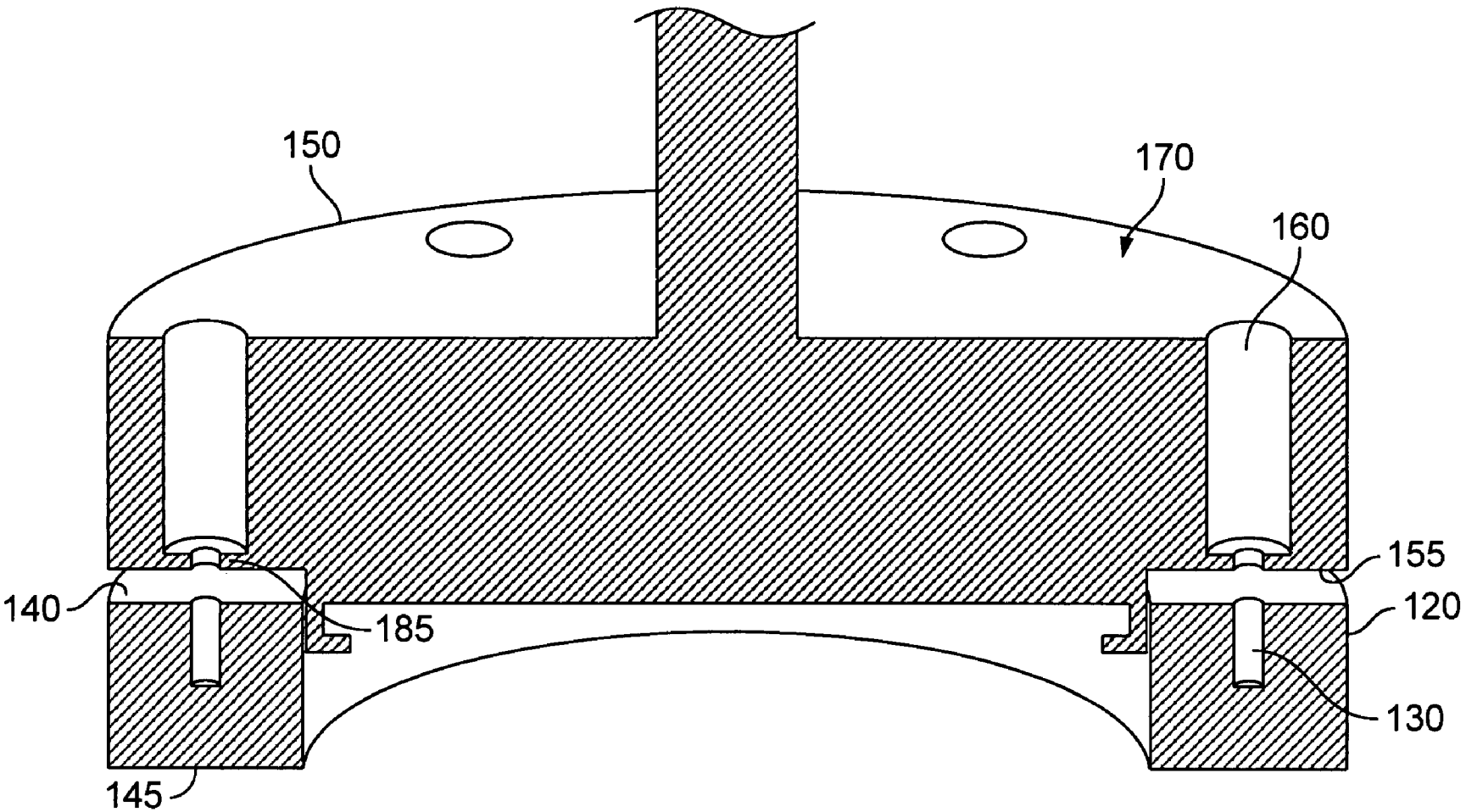
FIG. 3 is a cross section of two aligned components of a carrier head.

As shown in FIG. 3, the retaining ring 120 and the base 150 are aligned before the two components are attached together. The upper surface 140 of the retaining ring 120 faces a lower surface 155 of the base 150. The base 150 includes through-holes 160 for the fasteners. The holes 160 in the base 150 can have a stop 185 that prevents the fasteners 200 from escaping through the bottom of the base 150. The holes 160 in the base 150 are aligned with the holes 130 in the retaining ring 120. In some implementations, one or more additional components are located between the base 150 and the retaining ring 120, such as a gasket or a wave spring washer.

Figure 4:
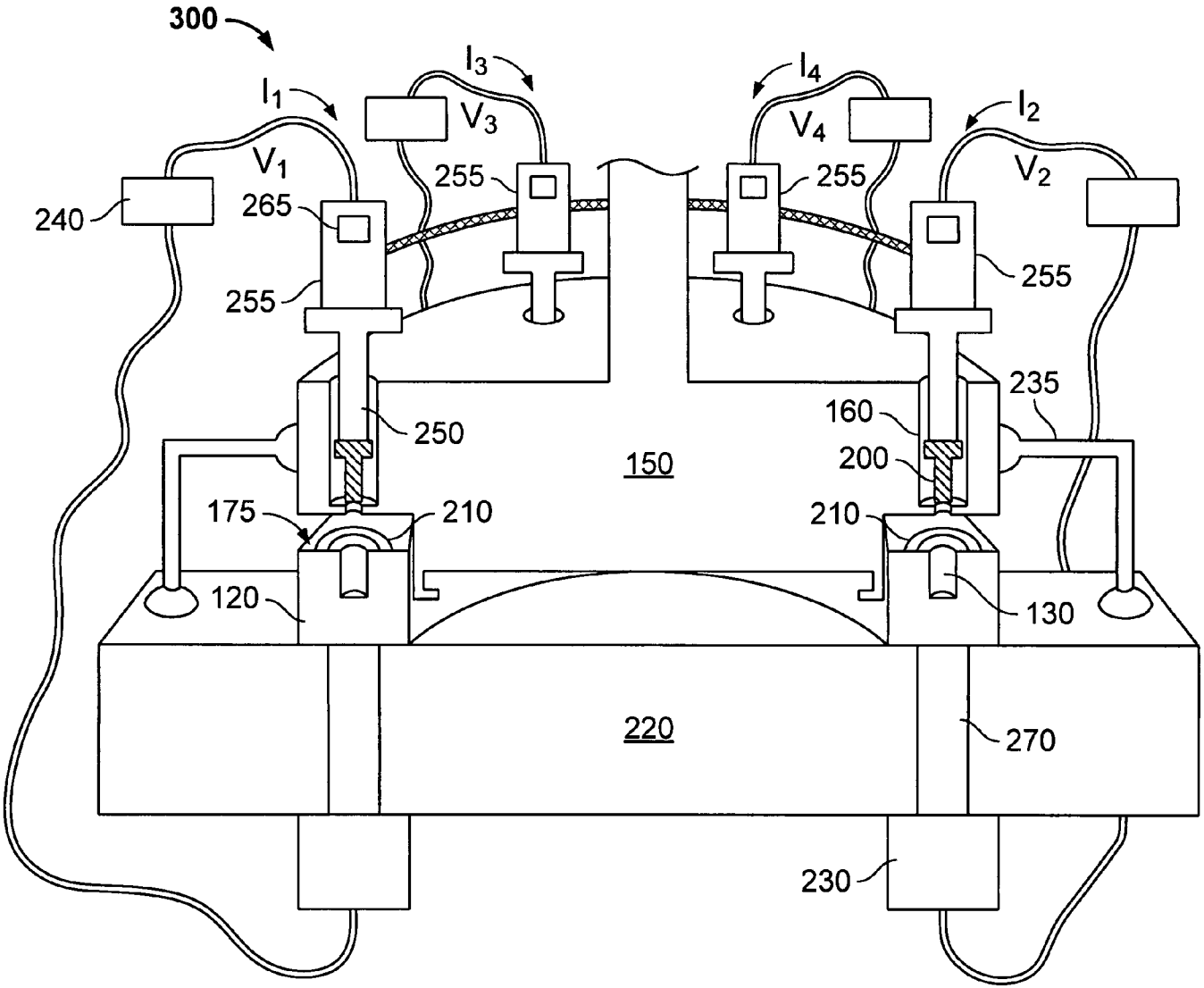
FIG. 4 is a schematic of a system for fastening together components of a carrier head.

As shown in FIG. 4, a fastening system 300 can be used to fasten the carrier head 100 components together. The fastening system 300 has multiple independently controllable drivers to drive fasteners into the components simultaneously. The fastening system 300 includes motor assemblies 255. The motor assemblies 255 are aligned with the locations of the holes 160 in the base 150. In one implementation, the motor assemblies 255 are moveable so that the fastening system 300 can be used with carrier heads having different hole configurations. The moveable motor assemblies 255 can be located on a track for adjusting the locations of the motor assemblies 255. Alternatively, the motor assemblies 255 can fit into a plate or other fixture configured to retain the motor assemblies at different locations on or around the component to be fastened.

Each motor assembly 255 includes a drive bit 250 and a motor. The motor assemblies 255 can additionally include a chuck, e.g., a magnetic chuck, for holding the drive bit 250. The drive bit 250 has a length sufficient to extend into the holes 160 of the base 150 and tighten the fastener 200 in place. The motor can apply a torque to the drive bit 250 to rotate the fastener.

The fastening system 300 has a motor control system 240 that controls the electrical input into each motor. The motor control system 240 can include a single controller that controls each motor, or separate controllers for each motor. The motor control system 240 can control the current and/or the voltage that is applied to each motor. The current and voltage applied to each motor determine, at least in part, the torque drive output of that motor. In general, the amount of torque drive output applied by the motor is proportional to current supplied to the motor. As more current is applied to the motor, more torque is applied to the fasteners.

In one implementation, the fastening system 300 includes a calibration system. The calibration system can compensate for motor-to-motor variability in actual torque produced for a given value of current or voltage delivered to a motor. The calibration system can include a torsional transducer 265 at each motor. The torsional transducer 265 monitors the torque applied to each fastener and supplies electrical voltage or current indicating, e.g., proportional to, the applied mechanical torque at the fastener. The torsional transducer 265 then sends the information to the motor control system 240. If a particular voltage or current applied to one or more of the motors applies a torque that is more or less than the torque applied by the other motors, the applied voltage or current can be adjusted so that the torque applied to each fastener is equal. Thus, the applied voltage or current at each motor can be adjusted so that the same torque is applied to each fastener.

In one implementation, the fastening system 300 can also include a monitoring system to monitor the progress of fastening the components together. The monitoring system can measure the orientation of the retaining ring 120 while the retaining ring 120 is being attached to the carrier head. The monitoring system can include a measuring device that measures a distance from the bottom of the retaining ring 120 to the measuring device, such as an optical measuring device, including a laser sensor 230. The retaining ring 120 can have the same number, more or fewer holes 130 than the number of laser sensors 230.

The fastening system 300 and components of the carrier head 100 that are to be fastened together can be located over or on a table 220. The table can be formed from granite. A granite surface can be polished to be very flat, such as to a tolerance of 0.1 mil, which is greater than the tolerance to which the retaining ring or the carrier head can be formed. The carrier head can be formed to a flatness of about 0.2 to 0.5 mil and the retaining ring can be formed to a flatness of about 0.2 to 0.5 mil. A holding fixture 235 holds the carrier head 100 above the retaining ring 120. The holding fixture 235 either has a very flat bottom or has legs, such as adjustable legs, that rest on the granite table and ensure that the rotational axis of the carrier head 100 is perpendicular to the surface of the granite table 220.

The table 220 can include recesses 270, in or below which are located the laser sensors 230. The laser sensors 230 can measure the distance from a location, such as the sensor or the table surface, to the bottom of the retaining ring 120. The laser sensors 230 are calibrated to determine that the sensors are positioned at equal distances from the surface of the granite table. The sensors can be calibrated with an optically finished gauge plate of equal or better flatness than the granite table. The gauge plate is placed on the granite table above the opening for the laser sensor to calibrate the distance to the surface of the granite plate. The calibrated laser sensors can take measurements at various locations around the retaining ring 120. The measurements can be used to determine the differences between the distances at each measured location. If the measurements are all equal, the bottom of the retaining ring 120 is parallel to the table and orthogonal to the central axis of the carrier head 100. The motor control system 240, or another computing device, can calculate the differences and can also determine whether any of the differences are outside of a predetermined range. For locations that are measured to have a difference outside of the predetermined range, the motor control system 240 can determine whether electrical input to one or more of the motors should be adjusted and how much to adjust the electrical input.

Figure 5A:
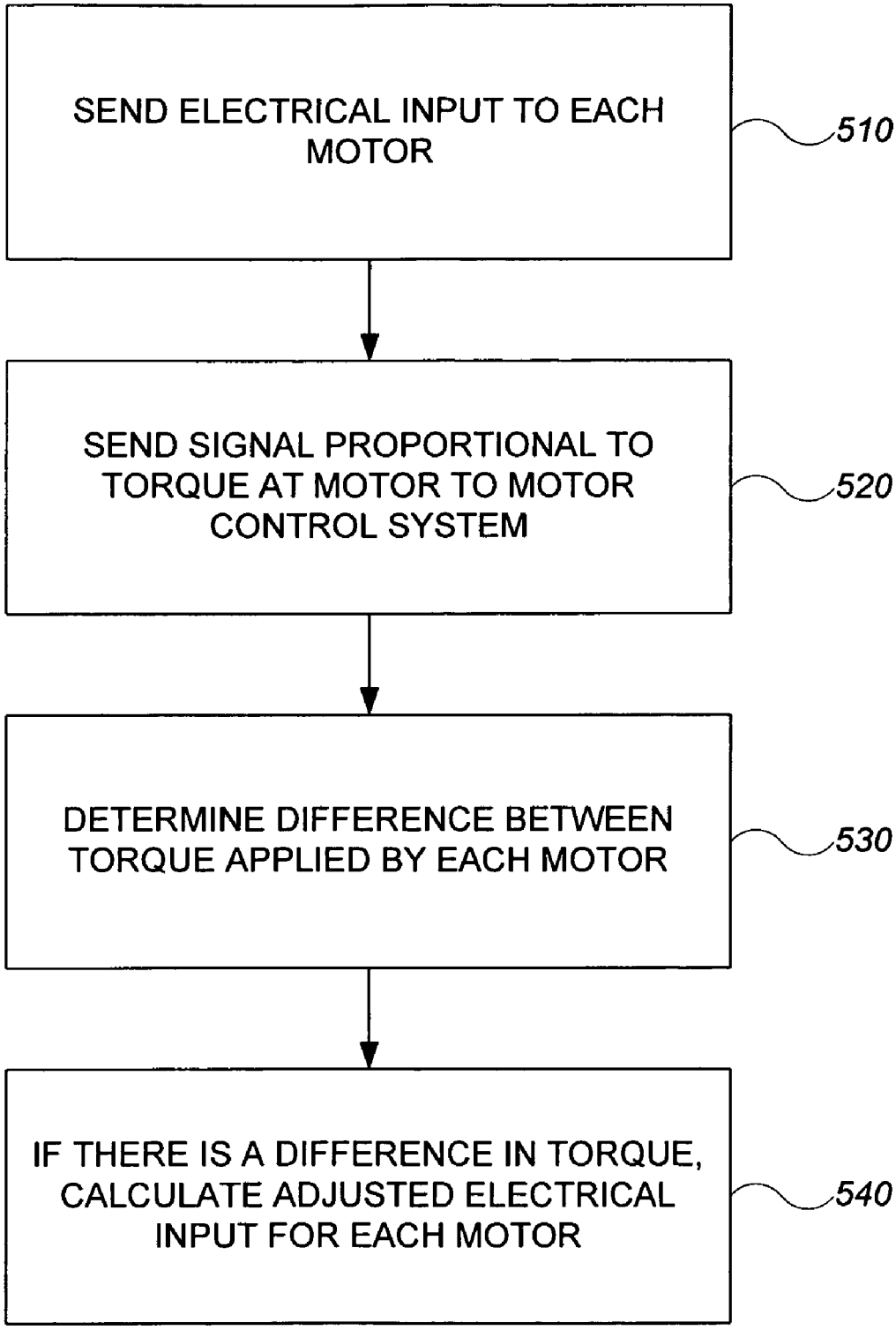
FIGS. 5A and 5B are flow diagrams for using and calibrating the fastening system.

Referring to FIG. 5A, prior to use of the fastening system, each of the motors can be calibrated as follows. The motor control system 240 sends substantially the same electrical input to each motor (step 510). A torsional transducer 265 at each motor 240 sends a signal to the motor control system 240 indicating the applied mechanical torque at the fastener (step 520). The motor control system 240 determines from the signals whether there is a difference between any of the applied mechanical torques at any of the motors (step 530). If there is a difference, the motor control system 240 calculates an adjusted electrical input for each motor, such that each motor applies equal torque (step 540).

Figure 5B:
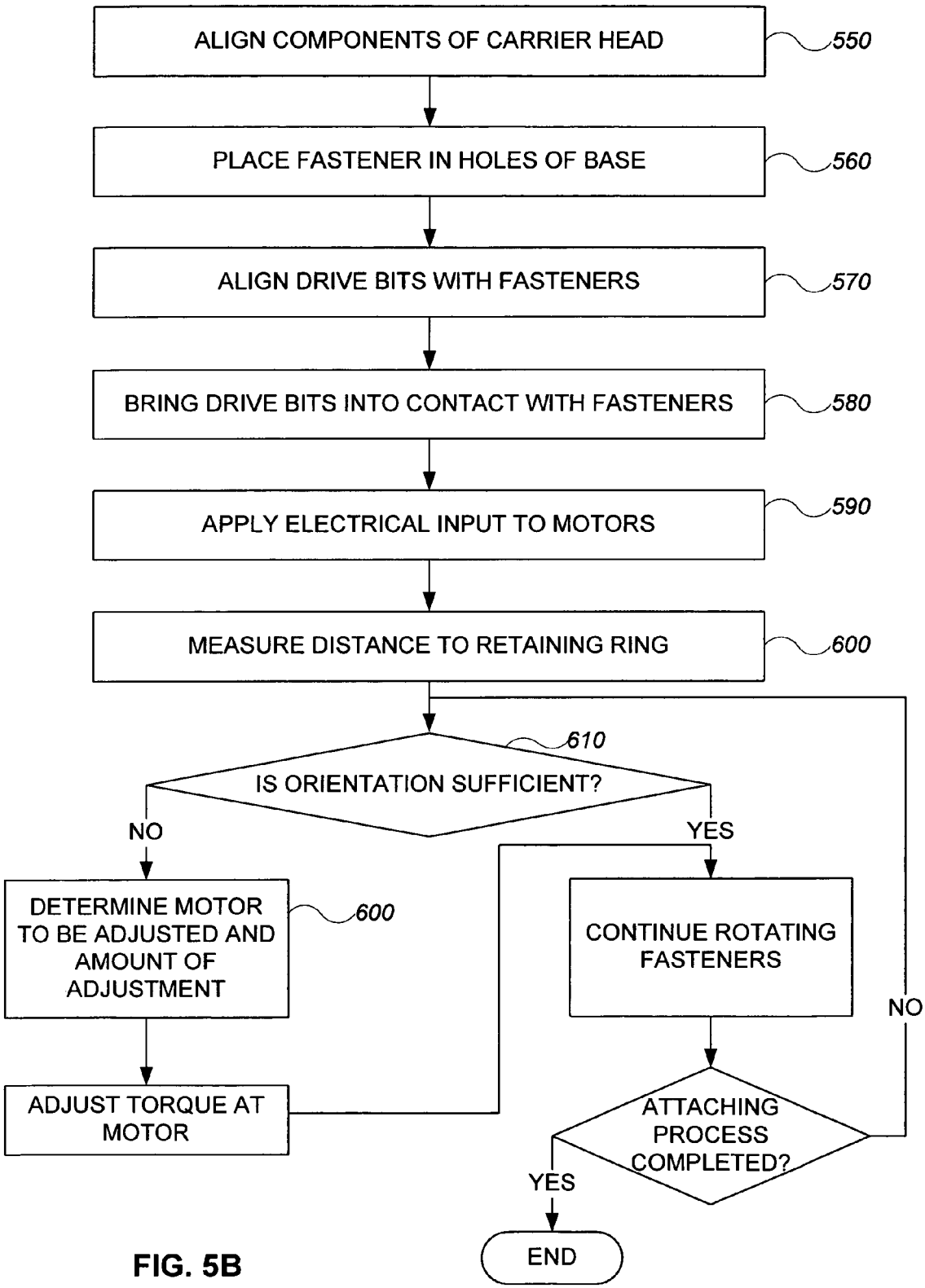

After the motors have been calibrated, the fastening assembly 300 can be used to secure portions of a carrier head 100 together, as described below. Referring to FIG. 5B, two portions of a carrier head 100 that are to be secured together, such as a retaining ring 120 and a base 150, are aligned (step 550). An adhesive 175 can be applied to the top surface 140 of the retaining ring 120, the lower surface 155 of the base 150 or to both surfaces. In addition, one or more gaskets, such as wave spring washers 210, can be placed between the base 150 and retaining ring 120. The wave spring washers 210 can provide a resistance to the torque. Providing wave spring washers 210 allows for stable positioning of the retaining ring before final holding torque is applied and while the epoxy is curing. The epoxy cure can take a number of hours or even days to complete. Once the epoxy is cured, the epoxy acts as a filler between the retaining ring and carrier head, thereby filling any gaps due to the uneven nature of the carrier head or retaining ring.

A fastener 200 is placed in each of the holes 160 of the base 150 (step 560). The carrier head and base 150 can be kept in a vertical position, so that the central axis of the base 150 is orthogonal to the table. The drive bits 250 are aligned with the fasteners 200 (step 570). The drive bits 250 are brought into contact with the fasteners 200, so that the drive bits 250 each engage with a recess or protrusion in the fasteners 200 and rotating the drive bits 250 causes the fasteners to turn (step 580). The fasteners 200 can be held on the bits 250, e.g., magnetically. An electrical input is applied to each motor (step 590). The electrical input can be equivalent at each motor, or the electrical input can differ according the calculated calibration (see step 540). The fasteners 200 extend into the retaining ring 120. The holes in the retaining ring 120 and the fasteners 200 can be threaded. When the fasteners are turned, the fasteners engage the retaining ring, pulling the retaining ring closer to the carrier head.

As the retaining ring 120 is attached to the base 150, the laser sensors 230 measure the orientation of the retaining ring (step 600). The orientation can be determined by taking measurements at various locations around the bottom of the retaining ring 120. The measurements can be compared to one another to determine whether the retaining ring 120 is being secured to the carrier head so that the bottom of the retaining ring 120 is parallel to the granite table or orthogonal to the central axis of the carrier head. The motor control system 240 determines whether the differences in the measurements fall outside of a predetermined threshold or whether the orientation of the retaining ring 120 is correct (step 610). A maximum desired difference between the measurements can be selected to set the predetermined threshold. If the differences between the measurements exceed the predetermined threshold, the orientation is not correct.

If the retaining ring 120 is not correctly oriented, the motor control system 240 determines which motor requires adjusting. In one implementation, the motor that corresponds to the portion of the retaining ring 120 that is furthest from the table is the motor to which the electrical input is decreased. For example, if the laser sensors 230 are all at the same distance from the surface of the granite table and a first sensor measures the bottom of the retaining ring at a first location as being further from the table than the bottom of the retaining ring at a second location is from the table, the motor control system 240 can reduce the electrical input to the motor corresponding to the first location on the retaining ring. Conversely, the electrical input to the motor corresponding to the location of the retaining ring that is closest to the table can be increased, thereby pulling that portion of the retaining ring toward the carrier head at a faster rate. As described above, the bottom of the retaining ring may not be flat. Adjusting the torque applied to one or more of the fasteners can compensate for the non-flatness of the ring and ensure that the bottom of retaining ring 120 is orthogonal to the central axis of the carrier head. The motor control system 240 determines how much to alter the electrical input according to the desired change in applied torque. The motor control system 240 then adjusts the electrical input to the motor, increasing or decreasing the torque at the motor (step 620). In one implementation, the motor control system can cause the motor to reverse direction and cause the fastener 200 to back out of the components.

If the motor control system 240 determines that the orientation is proper, the motor control system 240 continues to send electrical input to each of the motors until the retaining ring 120 is fully secured to the base 150. The laser sensors 230 can continue to measure the distance to the retaining ring 120 at various locations along the bottom of the retaining ring 120 throughout the fastening process.

In one implementation, the measuring system automatically converts the measured orientation to a displacement signal that varies the amount and direction of torque required to adjust and correct the orientation of the bottom of the retaining ring. The motor control system 240 can receive the displacement signal and cause the motor control system 240 to adjust the amount of electrical input to each motor.

When the specified orientation is achieved, that is, when the bottom of the retaining ring is not skewed from its desired orientation, and the retaining ring 120 and base 150 are in sufficiently close contact, the adhesive is allowed to cure. A final holding torque value can then be applied to the completed assembly.

In some implementations, a spray-on release agent can be applied to the mating surface of the carrier head before assembly. The release agent should be one that does not interfere with the chemical reaction or strength of the curing epoxy. The release agent allows for clean removal of the retaining ring and epoxy without damage to the carrier head when the time comes for removing or replacing the retaining ring.

Using the above described fastening device to attach multiple components of a carrier head together can ensure that the assembled carrier head has a bottom surface that is orthogonally oriented to a central axis of the carrier head. Fastening all of the fasteners simultaneously can reduce surface distortion on the bottom of a retaining ring that can be caused when the fasteners are only fastened one at a time. Fastening all of the fasteners simultaneously can enable reproducibility in attaching the carrier head components. Using conventional methods of attaching a retaining ring to a carrier head, such as by using a conventional torque wrench that can only be calibrated to +/−10% of nominal torque settings, can result in flatness, or lack thereof, of the assembly around 10 to 20 mils.

If the retaining ring is properly aligned with the carrier head, wear and tear on the retaining ring and other components of the carrier head assembly can be reduced and/or the components can wear at an even rate. A more even wear rate of the components can lead to a longer useful life-span of the consumable components of the carrier head. When the retaining ring is properly aligned with the carrier head, the time required to planarize the ring after assembly can be reduced or even eliminated. Further, the flatness of the retaining ring or carrier head base, which components are not necessarily produced with very high tolerance of flatness, need not be relied upon to form a carrier head assembly with a bottom orthogonal to the central axis. If the components are property aligned, the substrate may be polished more uniformly at the edge of the substrate, potentially creating an improved polishing profile.

A number of embodiments of the invention have been described. Nevertheless, it will be understood that various modifications may be made without departing from the spirit and scope of the invention. For example, the drive bit can be replaced by a mechanism capable of turning a non-screw style fastener. The fastening system can be used to fasten together components of the carrier head other than the base and the retaining ring. The measurements to the bottom of the retaining ring during the fastening process can be made relative to a position other than the surface of a table. The membrane can be secured to different positions on the carrier head, such as being clamped between the retaining ring and the base, or being secured to the retaining ring itself. The horizontal portions of the flap can extend outwardly rather than inwardly. The membrane can be attached to one or more support structures that float or rest inside the chambers. The membrane can be formed as a unitary piece, or it can be formed from multiple membranes that are joined together, e.g., by an adhesive. In addition, the perimeter portion of the membrane can be indirectly connected to the base, e.g., the perimeter portion can be connected to a rigid support structure which is connected in turn to the base by, for example, a flexure. In addition, it should be understood, the membrane configuration may still be useful even if the particular shape does decrease sensitivity to retaining ring wear. For example, the carrier head could have a retaining ring that does not contact the polishing pad, or no retaining ring at all. In addition, the terms horizontal and vertical refer to the position of the membrane components relative to the substrate receiving surface, so the invention is still applicable if the carrier head is oriented with the polishing surface above the substrate or with a vertical polishing surface. Accordingly, other embodiments are within the scope of the following claims.

What is claimed is:

1. A system for mechanically attaching parts of a carrier head, comprising:

two or more fastener drivers each configured to drive a fastener into components of the carrier head, wherein one of the components is a retaining ring;

a control system to regulate an electrical input to each of the fastener drivers; and a measuring system to measure whether the retaining ring is being attached to the carrier head so that a bottom surface of the retaining ring is orthogonal to a rotational center axis of the carrier head.

2. The system of claim 1, wherein:

the two or more fastener drivers are positioned within a circumferential area of one of the components; and the fastener drivers are equidistantly spaced along a circular path within the circumferential area.

3. The system of claim 1, wherein the control system controls the voltage supplied to each of the fastener drivers.

4. The system of claim 1, wherein the control system controls the current supplied to each of the fastener drivers.

5. The system of claim 1, wherein the control system causes the two or more fastener drivers to each drive a drive bit at substantially equal rates.

6. The system of claim 1, wherein:

the two or more fastener drivers each apply a torque to drive the fasteners; and the control system is configured to control the torque applied by each fastener driver such that the torque applied by each fastener driver is substantially equal.

7. The system of claim 1, wherein the measuring system is capable of measuring a distance from the retaining ring to the measuring system.

8. The system of claim 7, wherein the measuring system includes two or more optical measuring devices.

9. The system of claim 8, wherein each of the two or more optical measuring devices is substantially aligned with one of the fastener drivers.

10. The system of claim 7, wherein:

the measuring system is in communication with the control system such that the measuring system sends input to the control system regarding the distance of the retaining ring to the measuring system; and the control system is configured to determine whether the retaining ring is being attached to the carrier head so that a bottom surface of the retaining ring is orthogonal to the center axis of the carrier head, if the retaining ring is not being attached to the carrier head so that the bottom surface of the retaining ring is orthogonal to the center axis, the control system adjusts the electrical input into at least one of the fastener drivers to cause the retaining ring to be attached to the carrier head so that the bottom surface of the retaining ring is orthogonal to the center axis.

11. The system of claim 7, wherein the measuring system includes a laser optical measuring device.

12. The system of claim 7, wherein the measuring system includes at least three measuring devices.

13. The system of claim 1, wherein the fastener drivers each include a motor and the system further comprises:

a calibration system for determining a motor-to-motor variability in applied torque when a given value of current is delivered to each fastener driver.

14. The system of claim 13, wherein the calibration system includes torsional transducers operable to provide an electrical signal proportional to an applied mechanical torque at each fastener driver.

15. The system of claim 14, wherein the calibration system determines an adjustment value for the electrical input to each fastener driver, wherein an adjusted electrical input causes each of the fastener drivers to apply substantially equal torque.

16. A method of attaching a retaining ring to a carrier head, comprising:

aligning a retaining ring with a component of the carrier head, the retaining ring Havin g two or more holes, where each of the holes is configured to receive a fastener and the component is configured to retain the fasteners, the aligning including aligning the retaining ring and component with an attaching system comprising:

two or more fastener drivers each configured to drive a fastener into the retaining ring and the component of the carrier head;

a control system to regulate an electrical input to each of the fastener drivers; and a measuring system to measure whether the retaining ring is being attached to the carrier head so that a bottom surface of the retaining ring is orthogonal to a rotational center axis of the carrier head; and using the attaching system, driving the fasteners into the retaining ring and component so that the fasteners are driven into the retaining ring and component simultaneously.

17. The method of claim 16, further comprising measuring the orientation of the retaining ring as the fasteners are being driven into the retaining ring.

18. The method of claim 17, further comprising:

determining whether the orientation of the retaining ring is a desired orientation; and if the orientation of the retaining ring is not the desired orientation, adjusting the electrical input to at least one of the fastener drivers.

19. The method of claim 16, further comprising controlling an electrical input into the fastener drivers so that the fastener drivers drive the fasteners at a substantially equal rate.

* * * * *

UNITED STATES PATENT AND TRADEMARK OFFICE

CERTIFICATE OF CORRECTION

PATENT NO. : 7,530,153 B2
APPLICATION NO. : 11/233154
DATED : May 12, 2009
INVENTOR(S) : Trung T. Doan et al.

It is certified that error appears in the above-identified patent and that said Letters Patent is hereby corrected as shown below:

Column 10, Line 22 at Claim 16; replace:

"head, the retaining ring Havin g two or more holes," with

-- head, the retaining ring having two or more holes, --

Signed and Sealed this

Thirtieth Day of June, 2009

JOHN DOLL

*Acting Director of the United States Patent and Trademark Office*